US006616814B2

(12) United States Patent
Best

(10) Patent No.: US 6,616,814 B2
(45) Date of Patent: Sep. 9, 2003

(54) SHOE PRESS BELT FOR PAPER MACHINES

(75) Inventor: Walter Best, Duren (DE)

(73) Assignee: Thomas Josef Heimbach Gesellschaft mit beschrankter Haftung & Co. (DE)

( * ) Notice: Subject to any disclaimer, the term of this patent is extended or adjusted under 35 U.S.C. 154(b) by 0 days.

(21) Appl. No.: 09/870,769

(22) Filed: Jun. 1, 2001

(65) Prior Publication Data

US 2002/0060052 A1 May 23, 2002

(30) Foreign Application Priority Data

Jun. 6, 2000 (DE) ..... 100 27 853

(51) Int. Cl.[7] ..... D21F 3/00

(52) U.S. Cl. ..... 162/358.4; 162/358; 162/900; 162/358.2; 162/901; 162/306; 428/311.11; 428/314.4; 428/315.5; 428/315.7

(58) Field of Search ..... 162/358.4, 306, 162/901, 900, 358.2, 358; 428/311.11, 314.4, 314.2, 315.5, 315.7, 297.4

(56) References Cited

U.S. PATENT DOCUMENTS 4,552,620 A 11/1985 Adams ..... 162/358
4,701,368 A 10/1987 Kiuchi et al. ..... 428/233
5,772,848 A 6/1998 Dutt
6,383,339 B1 * 5/2002 Gstrein ..... 162/358.4

FOREIGN PATENT DOCUMENTS

DE 4125470 C1 11/1992
DE 3685975 2/1993
EP 0786550 7/1997

OTHER PUBLICATIONS

Polyurethane elastomer, pp. 1–2, Polymers—A Property Database, CRC Press, LLC, 2000.*
Polybutylene terephthalate, pp. 1–11, Polymers—A Property Database, CRC Press, LLC, 2000.*

* cited by examiner

*Primary Examiner*—Steven P. Griffin
*Assistant Examiner*—M. Halpern
(74) *Attorney, Agent, or Firm*—Liniak, Berenato & White, LLC

(57) ABSTRACT

The invention refers to a shoe press belt (1) for use in shoe presses of a paper machine, having a support (2) and a liquid-impermeable belt layer (3, 5) which has an inner layer (3) and an outer layer (5), the outer layer (5) having a porous structure and the porous structure being formed exclusively from cavities (8, 12, 14) open toward the outer side; and is characterized in that the outer layer (5) is made of an unfoamed material.

25 Claims, 1 Drawing Sheet

SHOE PRESS BELT FOR PAPER MACHINES

The invention concerns a shoe press belt for use in shoe presses of a paper machine, having a support and a liquid-impermeable belt layer which has an inner layer and an outer layer adjacent thereto, the outer layer having a porous structure and the porous structure being formed exclusively from cavities open toward the outer side.

A shoe press belt of this kind is evident from FIGS. 6 and 7 of U.S. Pat. No. 4,701,368. It has a liquid-impermeable belt layer that is constructed in two layers, with a liquid-impermeable inner layer and an outer layer adjacent thereto. In the one exemplary embodiment an additional support is present in the form of a fabric, while in the other exemplary embodiment the inner layer also simultaneously has a support function and thus forms the support. The outer layer, which is intended for direct contact against the paper web, can be made of a closed-pore or open-pore foam material; in the latter case, dewatering of the paper web is accomplished by way of the outer layer, and a press felt can thus be dispensed with.

The known shoe press belt has the disadvantage that the outer layer becomes practically completely compressed under the high pressure of the shoe press, since it consists only of the thin cell walls of the foam. The dewatering that is desirable at least with the open-pore version therefore occurs insufficiently or not at all.

U.S. Pat. No. 4,552,620 discloses a shoe press belt that comprises a woven support and a belt layer, applied on one or both sides, that is equipped throughout with a limited number of non-communicating pores. The pores have a diameter of 0.019 to 0.185 mm, and are said to produce a stone-like texture on the outer side provided for contact against the paper web. This texture is said to facilitate separation of the paper web from the shoe press belt after passing through the shoe press.

The shoe press belt described above has the disadvantage that the belt layer is very elastic because of the pores distributed over the entire cross section, and that it is therefore greatly compressed in the shoe press nip, with the consequence that the pores are also compressed. The pores are therefore not provided at all for the purpose of improving dewatering of the paper web, and also cannot do so.

It is the object of the invention to configure a shoe press belt of the kind cited initially in such a way that it is substantially more resistant to compression in the press nip and accordingly guarantees effective dewatering of the paper web.

This object is achieved, according to the present invention, in that the outer layer is made of an unfoamed material, i.e. preferably of a plastic material in which, however, only pores that are open toward the outer side are present. Otherwise the belt layer is homogeneous, and can therefore be adapted in accordance with particular requirements in terms of hardness, modulus of elasticity, etc. It has been found that with a shoe press belt constructed in this fashion, effective dewatering of the paper web (optionally assisted by a co-running press felt) is obtained.

The inner layer is advantageously of liquid-impermeable configuration and can be of longitudinally elastic and/or compressively elastic configuration. Preferably the specific modulus of the support should be $\leqq 500$ cN/tex. Materials such as PBT, PES, PA-6, PA-6,6, PA-6,10, PA-6,12, PA-11, PA-12, and PTT are suitable in particular for the inner layer; these materials can also be combined with one another.

As in the case of all belts for a paper machine, the support ensures the structural strength of the shoe press belt. For this purpose the support can be constructed of threads, for example in the form of a woven fabric, knitted fabric, or thread layer. Also suitable, however, are fiber batts of appropriately solid configuration, for example in impregnated or compressed form; if possible, these should possess a uniform thickness. On the side on which the coating is applied, the surface should be smooth, for example polished. In order to create a permanent join between support and coating, it is advantageous if the support is at least partially embedded into the coating. Complete embedding is also possible.

Natural rubber or an elastomer are suitable as the material for the inner layer. Silicone elastomer, polyester elastomer, and polyurethane are particularly suitable. The hardness of the inner layer should preferably be between 80 and 95 Shore A.

Inorganic filler particles, for example $TiO_2$ or clay, can additionally be incorporated into the inner layer in order to influence its hardness. It is advantageous in terms of the functionality of the inner layer if it has a thickness tolerance of max. 100 $\mu$m. To achieve such a tolerance, it can be appropriately machined down and polished before application of the outer layer.

Polyurethane and/or silicone elastomer and/or polyester elastomer is preferably suitable as the material for the outer layer. When these or other plastic materials are used, the cavities can be produced, in a manner known per se, by the fact that soluble particles are scattered onto and embedded into them, and are dissolved out with a solvent to which the outer layer is resistant (cf. EP-A 0 786 550). Water-soluble particles in the form of salts such as NaCl, KCl, and/or $CaCO_3$ are particularly suitable for this purpose. The particles should have a diameter of 10 $\mu$m to 1500 $\mu$m, preferably between 400 $\mu$m and 1000 $\mu$m, in a random distribution, in order to generate cavities of appropriate size.

In order to improve the wear resistance of the outer layer, it is proposed to equip it on its surface with a layer of nanoparticles. These particles, used heretofore in chemistry as pigments for color effects, cosmetics, and data storage layers, whose particle sizes are in the nanometer range, can effectively protect the outer layer from wear, in particular if the nanoparticles are made, for example, of $SiO_2$ or metals and form an almost continuous layer. The nanoparticles can be applied as a sol, the solvent (usually alcohol) then being evaporated. The nanoparticles can be equipped locally with fluorocarbon chains in order to give surface regions of the outer layer a hydrophobic character, and thereby to facilitate separation of the paper web from the shoe press belt.

A further alternative for producing the outer layer is to use an electron beam-cured prepolymer emulsion. Particularly suitable for this purpose are silicones or polyurethanes that are emulsified in a water-surfactant mixture which is evaporated upon electron beam curing.

Provision is also made according to the present invention for the outer layer to comprise, on the outer side, materials which form regions of differing hydrophilicity and hydrophobicity. Both are intended to facilitate separation of the paper web from the shoe press belt; the regions and the differences in terms of hydrophilicity and hydrophobicity are to be arranged and configured so that sufficient adhesion of the paper web is still ensured in the region where the press felt lifts off.

The shoe press belt advantageously has a hardness of between 80 Shore A and 95 Shore A, and a thickness tolerance of $\pm 50$ $\mu$m.

Provision is also made according to the present invention for a further layer, which is harder than the outer layer, to be provided between the outer layer and inner layer.

Lastly, it is proposed according to the present invention that the complete shoe press belt have a thickness tolerance of ±100 μm.

The invention is illustrated in further detail, with reference to schematically depicted exemplary embodiments, in the drawings, in which.

Figure 1:
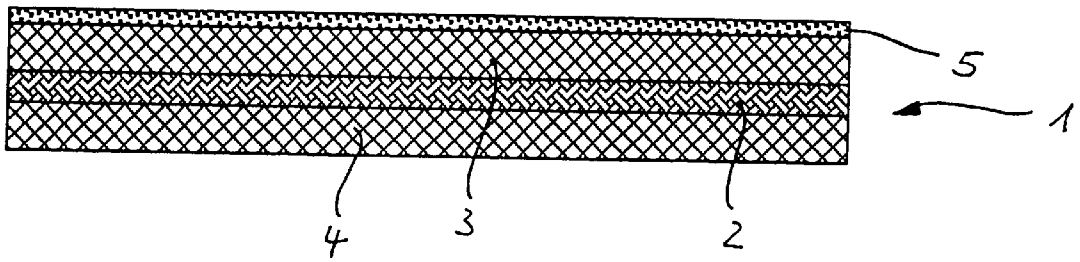
FIG. 1 shows a partial longitudinal section through a shoe press belt for a paper machine.

Shoe press belt 1 visible in FIG. 1 has a support 2 that is made in this case of a woven fabric using polyamide threads. Support 2 has on the upper side an inner layer 3 and on the lower side a base layer 4, support 2 being embedded into both layers 3, 4. Inner layer 3 and base layer 4 are made of a silicone elastomer.

An outer layer 5 which has a porous structure and a smooth surface 6 is applied onto the upper side of inner layer 3. Surface 6 is provided for contact with a paper web, while the lower side of base layer 4 runs over the rolls of a paper machine.

Figure 2:
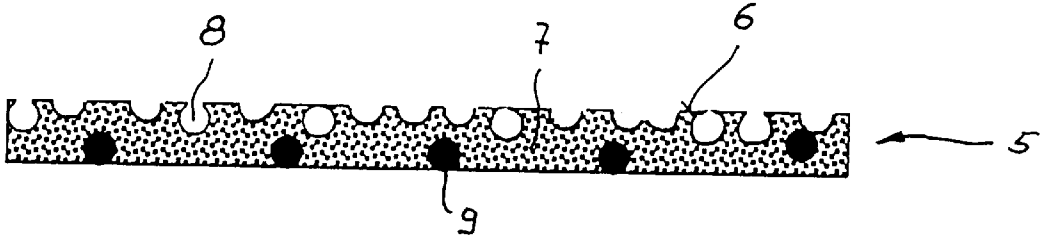
FIG. 2 shows a longitudinal section through a first embodiment of the outer layer of the shoe press belt of FIG. 1.

In the exemplary embodiment of FIG. 2, outer layer 5 substantially comprises a cast polyurethane layer 7. In order to produce in said polyurethane layer 7 cavities (labeled 8 by way of example) that are open toward the outer side, salt particles (labeled 9 by way of example) were incorporated into the polyurethane material, in uniformly distributed fashion and with a variable size distribution of from 10 μm to 1500 μm, before application. After the formation of polyurethane layer 7 on inner layer 3, those salt particles 9 that were not completely surrounded by polyurethane layer 7, i.e. that communicated with the outer side, were washed out with water. This created cavities 8 whose depth corresponds to the previous penetration depth of salt particles 9 and which are open toward the outside. Those salt particles 9 that were incorporated at a distance from surface 6 were not dissolved out, and are therefore still present in polyurethane layer 7.

Cavities 8 interrupt surface 6; but regions of surface 6 that lie in one plane, and are smooth and connected to one another, nevertheless remain between the openings of the cavities. A large contact surface is thus offered to the paper web, thus creating a correspondingly high adhesion force. Because of their expansion after passing through the press nip, cavities 8 generate a negative pressure which assists adhesion of the paper web to surface 6.

Figure 3:
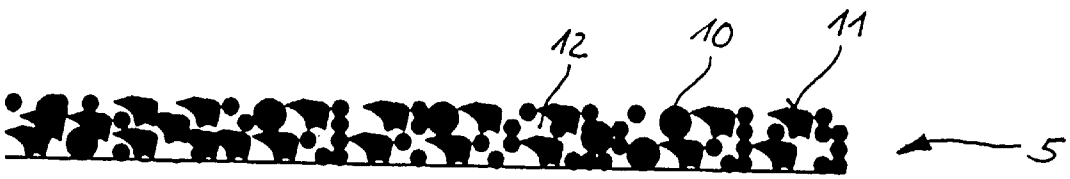
FIG. 3 shows a longitudinal section through a second embodiment of an outer layer of the shoe press belt of FIG. 1.

In the exemplary embodiment of an outer-layer 5 depicted in FIG. 3, the starting material is also polyurethane. Here, however, this material is applied in powder form and then sintered, so that here again a polyurethane layer 10 with a smooth surface 11 has formed. Salt particles were incorporated into the polyurethane powder (cf. in this connection the method described in EP-A 0 786 550) and were then completely dissolved out by way of a washing process so that a porous structure was created, forming cavities (labeled 12 by way of example) open toward the surface. The effect of polyurethane layer 10 is the same as that of polyurethane layer 7 as shown in FIG. 2.

Figure 4:
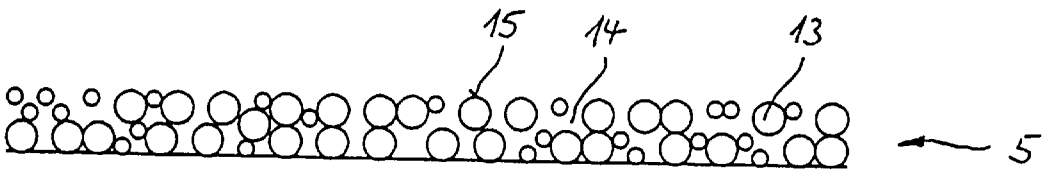
FIG. 4 shows a longitudinal section through a third embodiment of an outer layer of the shoe press belt of FIG. 1.

The exemplary embodiment shown in FIG. 4 shows an outer layer 5 that was produced from a emulsion of prepolymers. This emulsion was applied onto inner layer 3 and then cured with an electron beam. This resulted in the creation of individual, mutually connected polymer particles (labeled 13 by way of example) between which cavities (labeled 14 by way of example) have formed. The overall result of this, too, is to create a porous structure having a comparatively smooth surface 15.

What is claimed is:

1. A shoe press belt for use in shoe presses of a paper machine, having a support and a liquid-impermeable belt layer attached to the support, said liquid impermeable belt layer comprising an inner layer and an outer layer, said outer layer having a porous structure and said porous structure being formed exclusively from cavities opening toward an outer side of said belt layer, wherein said outer layer is made of an unfoamed material.

2. The shoe press belt as defined in claim 1, wherein the inner layer (3) is liquid-impermeable.

3. The shoe press belt as defined in claim 1, wherein the inner layer is of longitudinally elastic and/or compressively elastic configuration.

4. The shoe press belt as defined in claim 1, wherein the support has in the longitudinal direction a specific modulus of ≦500 cN/tex.

5. The shoe press belt as defined in claim 1, wherein the support is a woven fabric, knitted fabric, thread layer, or fiber batt, or a combination thereof.

6. The shoe press belt as defined in claim 1, wherein the support is at least partially embedded into the inner layer.

7. The shoe press belt as defined in claim 1, wherein the inner layer is made of natural rubber or an elastomer, in particular silicone elastomer, polyurethane, and/or polyester elastomer.

8. The shoe press belt as defined in claim 1, wherein the inner layer has a hardness of between 80 and 95 Shore A.

9. The shoe press belt as defined in claim 1, wherein the inner layer comprises inorganic filler particles.

10. The shoe press belt as defined in claim 1, wherein the inner layer has a thickness tolerance of max. 100 μm.

11. The shoe press belt as defined in claim 1, wherein the outer layer is made of polyurethane and/or silicone elastomer and/or polyester elastomer.

12. The shoe press belt as defined in claim 1, wherein the cavities in the outer layer have an average diameter of 10 μm to 1500 μm.

13. The shoe press belt as defined in claim 1, wherein the outer layer is equipped on its surface with nanoparticles which form a partially continuos layer.

14. The shoe press belt as defined in claim 13, wherein the nanoparticles are made at least partially of $SiO_2$.

15. The shoe press belt as defined in claim 13, wherein the nanoparticles comprise fluorocarbon chains.

16. The shoe press belt as defined in claim 1, wherein the outer layer is made of an electron beam-cured prepolymer emulsion.

17. The shoe press belt as defined in claim 1, wherein the outer layer comprises, on the outer side, materials which form regions of differing hydrophilicity and hydrophobicity.

18. The shoe press belt as defined in claim 1, wherein the outer layer has a thickness of 3 mm and the inner layer has a thickness of 1–3 mm.

19. The shoe press belt as defined in claim 1, wherein the outer layer has a hardness of between 80 Shore A and 95 Shore A.

20. The shoe press belt as defined in claim 1, wherein the outer layer has a thickness tolerance of ±50 μm.

21. The shoe press belt as defined in claim 1, wherein a further layer, which is harder than the outer layer is arranged between the outer layer and inner layer.

22. The shoe press belt as defined in claim 1, wherein the shoe press belt as a whole has a thickness tolerance of ±100 μm.

23. A shoe press belt for use in shoe presses of a paper machine, having a support and a liquid-impermeable belt layer which has an inner layer and an outer layer the outer layer having a porous structure and the porous structure being formed exclusively from cavities open toward the outer side, wherein the outer layer is made of a non-fibrous unfoamed material.

24. The shoe press belt of claim 23, wherein said outer layer is a cast polymer.

25. A shoe press belt for use in shoe presses of a paper machine, having a support and a liquid-impermeable belt layer which has an inner layer and an outer layer, the outer layer having a porous structure and the porous structure being formed exclusively from cavities open toward the outer side, wherein the outer layer is made of a cast unfoamed material.

* * * * *